US008511023B1

(12) United States Patent
Gulbrandsen et al.

(10) Patent No.: US 8,511,023 B1
(45) Date of Patent: Aug. 20, 2013

(54) WALL PANEL MOUNTING SYSTEM

(71) Applicant: USG Interiors, LLC, Chicago, IL (US)

(72) Inventors: Peder Gulbrandsen, Aurora, IL (US); Gregory M. Ahren, Avon Lake, OH (US); John D. Bankston, Amherst, OH (US)

(73) Assignee: USG Interiors, LLC, Chicago, IL (US)

( * ) Notice: Subject to any disclaimer, the term of this patent is extended or adjusted under 35 U.S.C. 154(b) by 0 days.

(21) Appl. No.: 13/669,686

(22) Filed: Nov. 6, 2012

(51) Int. Cl.

| | |
|---|---|
| ***E04F 13/08*** | (2006.01) |
| ***E04B 5/00*** | (2006.01) |
| ***E04B 2/00*** | (2006.01) |
| ***E04B 9/00*** | (2006.01) |
| *E04B 9/30* | (2006.01) |

(52) U.S. Cl.
CPC ..... *E04F 13/0862* (2013.01); *E04B 9/30* (2013.01)
USPC ..... 52/385; 52/506.06

(58) Field of Classification Search
USPC ..... 52/506.06–506.1, 716.1, 716.8, 718.01, 52/718.04, 718.06, 718.03, 717.03, 717.05, 52/717.06, 384, 385, 664–667; 362/147, 362/148, 150, 151, 225, 404; 454/248, 264, 454/292, 296
See application file for complete search history.

(56) References Cited

U.S. PATENT DOCUMENTS

| | | | | |
|---|---|---|---|---|
| 4,640,064 | A * | 2/1987 | Goodworth, II | 52/506.08 |
| 4,744,188 | A * | 5/1988 | Ahren | 52/506.07 |
| 6,467,228 | B1 * | 10/2002 | Wendt et al. | 52/506.07 |
| 7,392,629 | B1 * | 7/2008 | Bankston et al. | 52/506.07 |
| 2005/0217194 | A1 * | 10/2005 | Krantz-Lilienthal et al. | 52/506.06 |
| 2007/0113513 | A1 * | 5/2007 | Wendt | 52/665 |

OTHER PUBLICATIONS

USG Interiors, Inc., Celebration and Geometrix Panels—Wall Mount Solution publication, pp. 1-8, Copyright 2006.

* cited by examiner

*Primary Examiner* — William Gilbert
*Assistant Examiner* — Kyle Walraed-Sullivan
(74) *Attorney, Agent, or Firm* — Pearne & Gordon LLP

(57) ABSTRACT

Mounting systems for attaching metal suspended ceiling panels to form a decorative rectangular array. In one system the panels are mounted on bolt slot grid runners spaced from the wall and trimmed with island ceiling trim. In another system, panels are mounted on unique backer boards that protect the panels against physical damage by resisting compressive forces on the face of the panels.

2 Claims, 4 Drawing Sheets

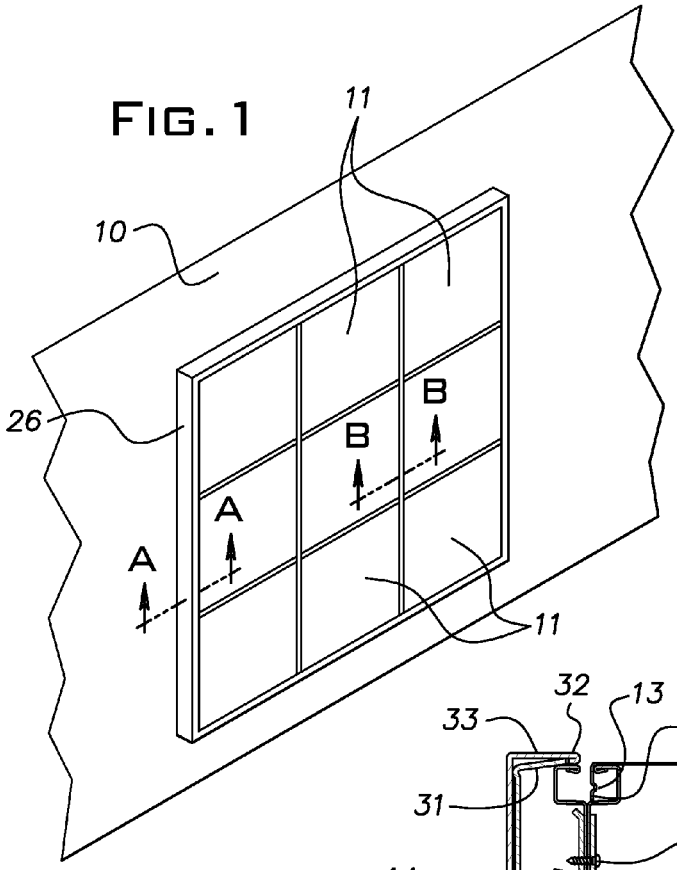
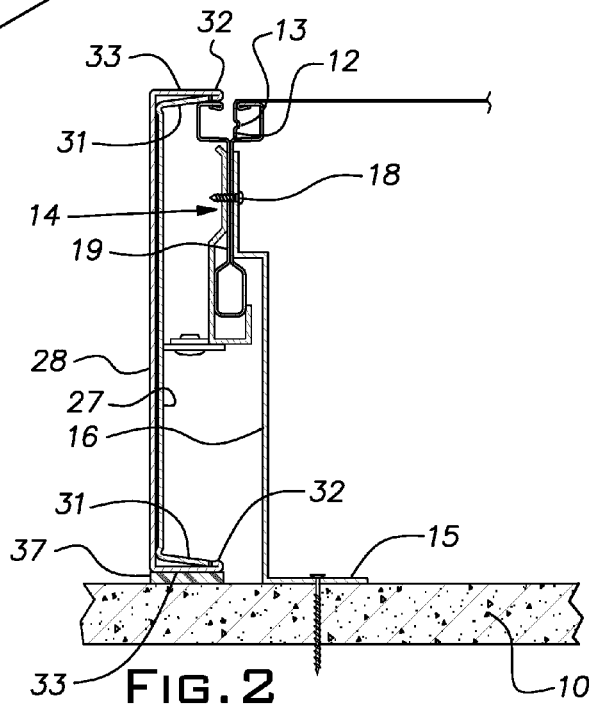
FIG. 2

WALL PANEL MOUNTING SYSTEM

BACKGROUND OF THE INVENTION

The invention relates to mounting systems for decorative wall panels.

PRIOR ART

Prior arrangements for mounting an array of rectangular metal ceiling panels on vertical walls or like surfaces have required expensive, specially produced hardware. Prior art hardware for such systems was limited in the depth that was afforded behind the panels for backlighting or other effects and could not protect central areas of the panels from damage when struck accidentally or from vandalism.

SUMMARY OF THE INVENTION

The invention provides unique systems for mounting rectangular metal ceiling panels on a wall or other vertical surface. The disclosed mounting systems are relatively inexpensive and use, for the most part, standard hardware and common construction materials.

In one embodiment of the invention, the mounting system utilizes various standard suspension ceiling components to support the rectangular panels. The invention, as a result of adopting standard components, reduces system costs and requisite skill and labor for installation. Moreover, the invention makes it practical to offer several different standoff dimensions from wall to rectangular panel.

In another embodiment of the invention, a backer panel is configured to provide both a mounting function and damage resistance for a metal ceiling panel. The backer panel or board can be constructed of a common construction material such as MDF (medium density fiberboard). The backer panel can be produced with minimal tooling investment and requires minimal accessories for a finished installation.

BRIEF DESCRIPTION OF THE DRAWINGS

FIG. 1 is a schematic isometric view of a wall on which is installed an array of rectangular panels;

FIG. 2 is a fragmentary cross-sectional view, indicated by the arrows A-A in FIG. 1 of a perimeter area of the installation according to a first embodiment of the invention;

DESCRIPTION OF THE PREFERRED EMBODIMENTS

Figure 2A:
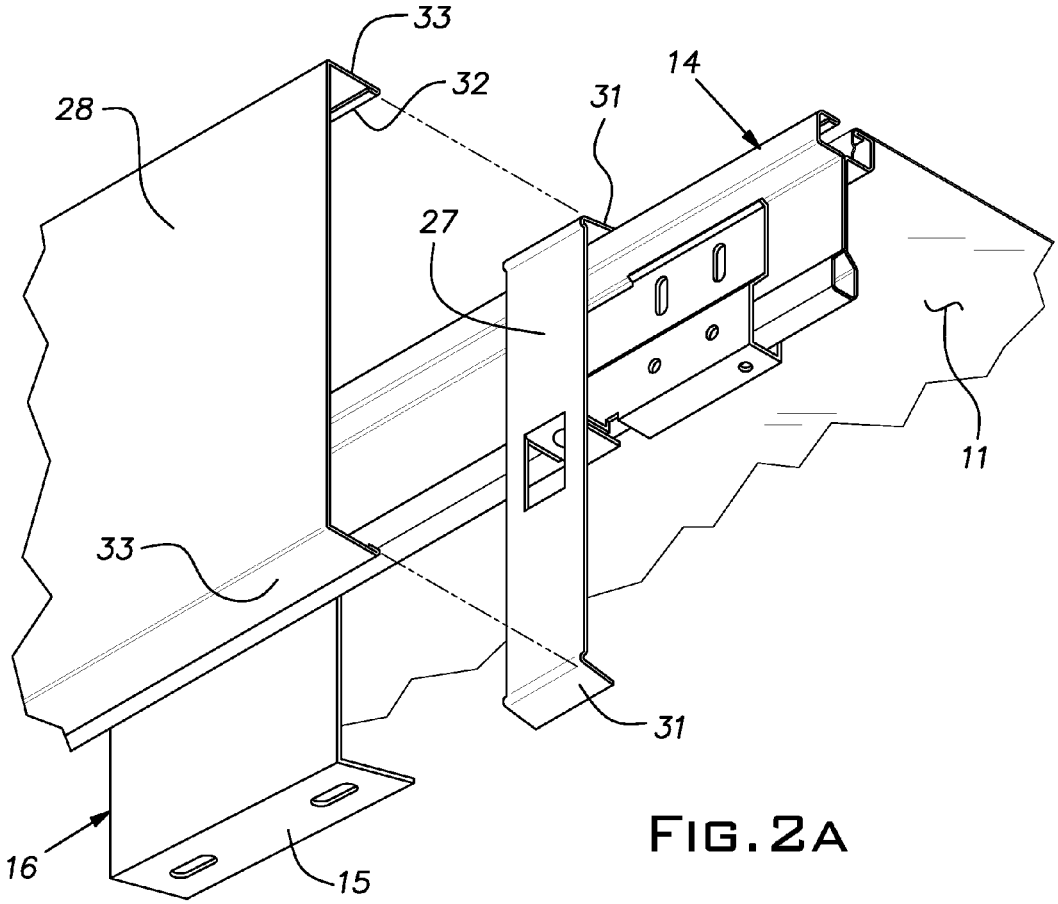
FIG. 2A is an exploded fragmentary view of a clip mounting a perimeter trim channel on a grid runner mounted on a wall.

FIG. 1 schematically illustrates a wall or like vertical support 10 on which an array of metal ceiling panels 11 are mounted with a system of the invention. The ceiling panels 11 are generally known in the construction industry such as those marketed under the trademark Celebration™ by USG Interiors, LLC. The panels 11, formed of high strength steel or hard aluminum are pan-shaped, having nominal face dimensions typically of 2 foot×2 foot or industry metric equivalent. Edges of the panels are formed with flanges 12 generally perpendicular to the panel face. The flanges are somewhat reentrant at their mid-sections 13 for purposes of securing the panels to a mounting structure. Ordinarily, the panels will only be mounted on a local area of the wall 10 to provide a design feature; the array of panels 11 should be spaced from the floor to avoid being struck by carts and floor sweepers and like equipment.

Figure 3:
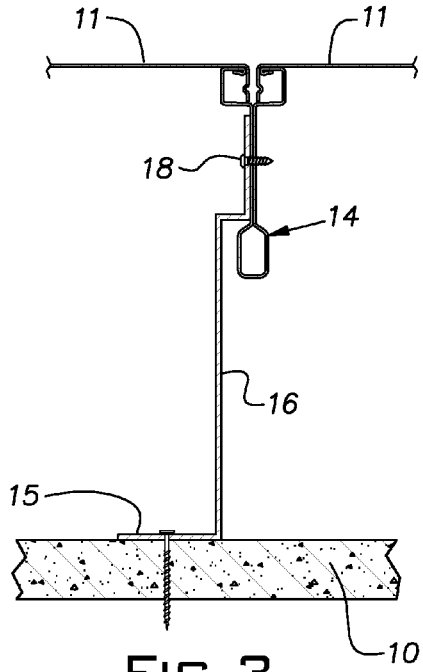
FIG. 3 is a fragmentary cross-sectional view, indicated by the arrows B-B in FIG. 1 showing details of a typical joint between two adjacent panels.
Figure 4:
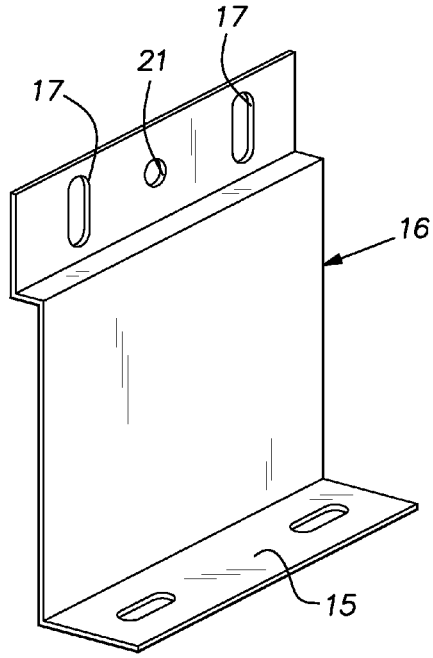
FIG. 4 is an isometric view of a bracket used to mount tees that support peripheral edges of the decorative panels of the first embodiment.

FIGS. 2-4 illustrate details of a first embodiment of the invention for mounting panels 11 on the wall 10 with sufficient space to effectively backlight the panel with a light source or sources (not shown) disposed between a panel 11 and the wall. A matrix or grid of "bolt slot" runners 14 is utilized to support the panels 11 in spaced relation to the wall 10. Preferably, the runners 14 are arranged with main runners on 24 inch centers and cross runners similarly on 24 inch centers. Industry metric equivalents of these dimensions can be used.

Main runners 14, conveniently arranged vertically on the wall 10 are supported by spaced wall mounting brackets 16 shown in FIG. 4. The brackets 16 can, for example, be spaced along the main runners 14 at a regular distance between successive cross runners, i.e. on 24 inch centers. The brackets 16 can be proportioned to support the ceiling panels at a desired distance of, for example, 4 inches, 6 inches, or 8 inches from the wall 10. The brackets 16 are provided with slots 17 to receive self-tapping screws 18 that are driven into a web 19 of the main runner 14. The slots 17 afford a limited adjustability to accommodate tolerances in assembly of the various parts and variations of flatness in the wall 10. When a runner 14 is properly adjusted, a screw 18 can be used in a hole 21 to lock the runner in place. The brackets have feet 15 with holes for accepting screws to mount the brackets on the wall 10.

It is desirable that the array 25 of panels 11 have as its periphery 26 suitably trimmed to conceal the mounting details and give the array 25 a finished appearance. In the embodiment illustrated in FIGS. 2-4, the periphery 26 can be trimmed by standard suspended ceiling island trim such as that marketed by USG Interiors, LLC under the trademark Compasso®. This trim system includes brackets 27 which attach to the runners 14 and trim channels 28 to form a continuous outline at the periphery 26 of the array of panels 11. FIG. 2A illustrates a runner 14, bracket or clip 27, and trim channel 28 in exploded relation. With reference to FIGS. 2 and 2A, the grid runner 14 is fixed to the wall 10 by the bracket 16 and the trim channel is fixed to the grid runner 14 by the clip 27. The clip 27 is secured to a reinforcing bulb 29 and/or web 30 of the runner with self-tapping screws. It will be seen that the clip 27 has flanges 31 that interengage with hems 32 on narrow flanges 33 of the shallow trim channels 28. The grid members or runners 14 can be of the type marketed under the trademark FINELINE® by USG Interiors, LLC. Besides the illustrated attachment clip 27, the suspended ceiling industry offers accessories for the trim channel 28 which include outside corners and splices.

It will be seen from FIGS. 2 and 3 that the panels 11 are snapped onto flanges 36 forming the bolt slots of the runners 14. The utilization of standard suspended ceiling grid components including the runners 14, clips 27, and channels 28 enable the construction of a wall mounting system for the ceiling panels 11 which is economical and readily installed by technicians who are familiar with suspended ceiling technology. The adaptation of these suspended ceiling accessories to a wall mounting system greatly reduces costs to a manufacturer since the majority of components are already in existence. The outside corners, typically, are factory made, greatly simplifying field construction of the array. Conventional metal ceiling panels are perforated with uniformly spaced holes running along orthogonal lines parallel to the edges of the faces of the panels. More recently hole or perforation patterns have been arranged to depict the image of an object. These perforated ceiling panels can be backlit, i.e. provided with a light source between the panel and the underlying wall supporting the panel array for a dramatic effect. The arrangement of the runners provided by the present invention allows adequate space, for example, 4, 6 or 8 inches between the panel and wall to provide adequate spacing to obtain a uniform light distribution. A compressible foam rubber strip 37 can be adhesively attached to the flanges 33 of a trim channel 28 to block any light from the space enclosed by the panels 11 and trim channels. Backlighting of apertured panels 11 is particularly desirable where the apertures create an image by their placement and size; an example of commercially available panels having this feature is the product line marketed under the mark PIXELS® by USG Interiors, LLC.

FIGS. 5-8 illustrate details of a backer board 40 constructed in accordance with a second embodiment of the invention. The backer board 40, preferably, is made from medium density fiberboard (MDF), although it may be made of other similar material suitable for this purpose. The board is nominally 24 inches square (or industry metric equivalent). Preferably, the backer board or panel 40 has a thickness of ¾ inch (or industry metric equivalent). Each edge 41 of the board 40 is routed with an identical profile. A base or backside 43 of the backer board 40 has the referenced nominal 24 inch dimension. This backer base has a thickness slightly less than a third of the total thickness of the backer board 40. A deep groove 44 separates the base 43, at the periphery of the board 40, from an undercut central area 46. Forward of the undercut area 46, the edge profile is enlarged at a band 47, thus forming a rearwardly facing shoulder surface 48. Forward of the band 47, the edge profile includes a beveled surface 49 which in the illustrated instance, lies in a plane 15 degrees off a line perpendicular to the plane of the board 40. On a rear face 51 the board are small elastomeric standoffs or bumpers 52 adhesively attached diagonally inward from a respective corner. The elastomeric or rubber standoffs 52 serve to bridge the panel across irregularities on a wall surface to which it is attached. On a forward face 53, the backer board 40 has a set of four countersunk through holes 54, one adjacent each corner of the board.

Figure 7:
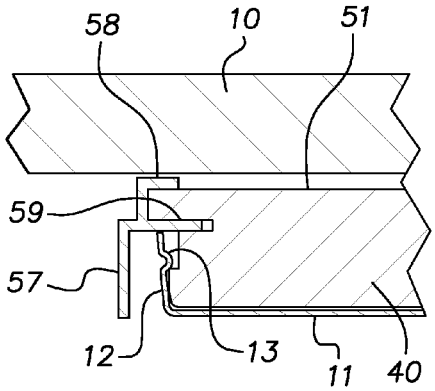
FIG. 7 is a cross-sectional view of a peripheral area of a decorative panel installation with the mounting system of the second embodiment taken at the line A-A of FIG. 1.
Figure 8:
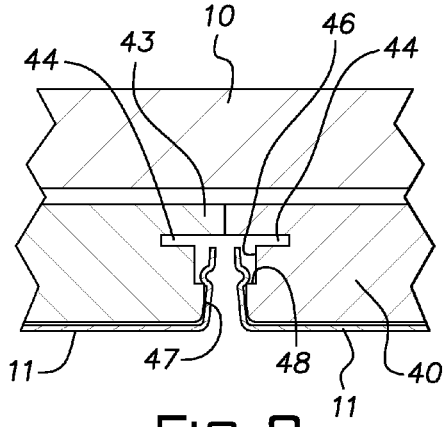
FIG. 8 is a fragmentary cross-sectional view of a central area of the decorative panel mounting system of the second embodiment taken at the line B-B of FIG. 1.
Figure 5:
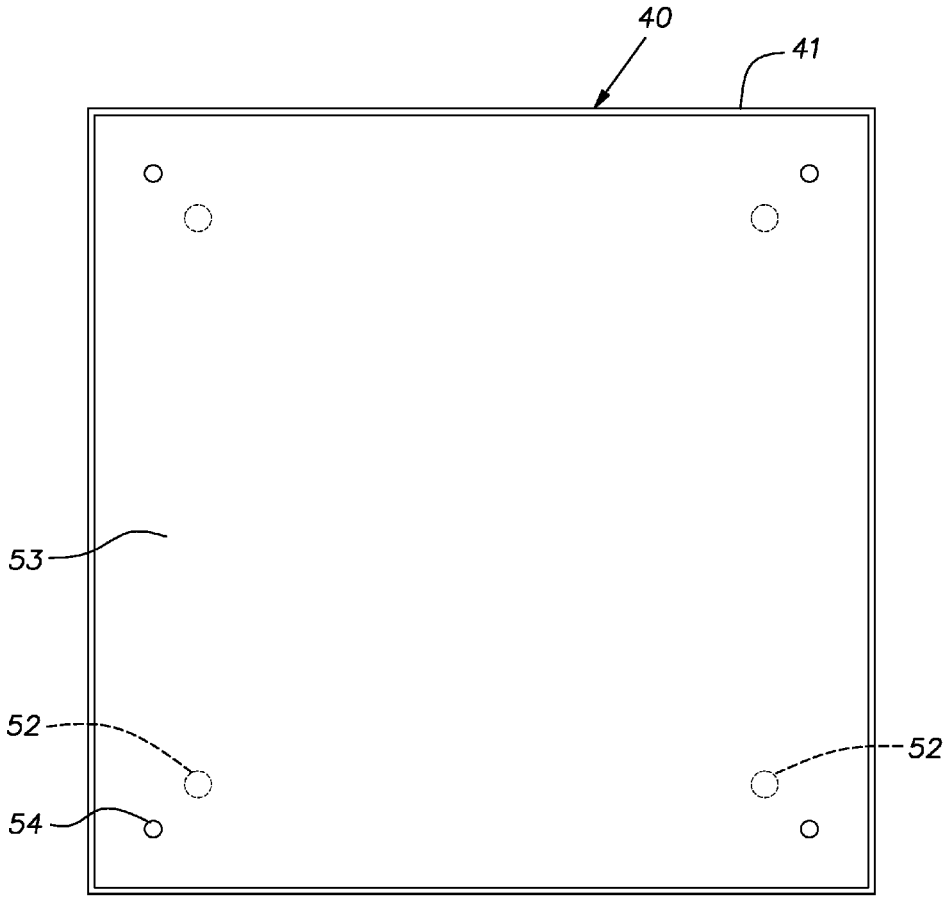
FIG. 5 is a front face view of a backer board for a decorative panel in accordance with a second embodiment of the invention.
Figure 6:
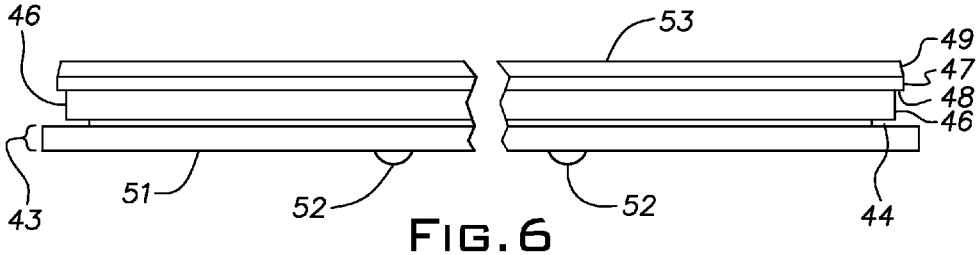
FIG. 6 is a typical edge view of the inventive backer board of FIG. 5.

A plurality of boards 40 are secured in a rectangular array, such as that depicted in FIG. 1. The board 40 can be attached to a wall 10 by self-drilling screws (not shown) positioned in the countersunk holes 54 and screwed into the wall 10. As indicated in FIG. 8, which corresponds with the section lines B-B in FIG. 1, the boards 40 are abutted against adjacent boards. Inspection of FIGS. 7 and 8 reveals that the edge profile 41 is configured to receive a flange 12 of a metal ceiling panel 11. The reentrant area 13 of a flange 12 is adapted to be received in the peripheral valley of a board 40 bounded by the shoulder surface 48, undercut area 46, and base 43. The bevel surface 49 on the periphery of the board 40 operates as a cam to cause a respective panel flange 12 to spread slightly outward as a panel 11 is forced onto a board until the reentrant area 13 snaps into the valley behind the rearward facing shoulder surface 48. FIGS. 7 and 8 show that when a panel 11 is mounted on a backer board 40, the entire face of the panel is backed up by the board. This back-up function of the backer board 40 reduces the potential for a panel 11 to be dented or creased inward or otherwise damaged.

Referring to FIG. 7, which corresponds to the section lines A-A of FIG. 1, the array of backer boards 40 can be trimmed at its periphery by an edge trim piece 57 having a generally F shape cross-section. As indicated in FIG. 7, one flange 58 of the trim 57 slips behind the backer board 40 while a central flange 59 of the trim is received in the deep narrow groove 44. The trim 57 can be installed before the screws in the holes 54 are fully tightened. The spacing between the wall 10 and backer board 40 provided by the rubber standoffs 52 facilitates the reception of the trim flange 58 behind the backer boards.

The illustrated backer boards 40 can be manufactured at very low cost since they are constructed of a common construction board stock and their edge profile 41 can be cut with a single router or shaping bit.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A decorative panel array on a supporting wall comprising a plurality of main runners and cross runners assembled between the main runners, the main runners and the cross runners each having bolt slots extending continuously along substantially their full lengths and open in a forward direction, a set of wall brackets attaching the runners to the wall, the runners being spaced a predetermined distance from the wall, a plurality of square metal ceiling panels carried on the runners, the aforesaid panels having rearwardly directed peripheral flanges with reentrant areas received and retained in the bolt slots of the runners, a rectangular periphery of the array having four sides being trimmed by shallow trim channels extending substantially continuously along said four sides, the channels being retained on adjacent ones of said runners by clips secured to said adjacent runners, the trim channels having parallel flanges and an intermediate web, one of the trim channel flanges bearing directly against the wall or bearing against a compressible gasket engaging the wall, another of the flanges overlying a portion of a bolt slot of an adjacent runner.

2. A decorative panel array as set forth in claim 1, wherein the wall brackets each have a foot abutting the wall and a portion abutting a web of a respective one of said runners.

* * * * *